United States Patent [19]

Bass et al.

[11] 4,402,552

[45] Sep. 6, 1983

[54] OPEN SURFACE FLOTATION METHOD FOR EXTRACTED CRUDE OIL

[75] Inventors: Dan M. Bass; Fun-Den Wang, both of Golden, Colo.

[73] Assignee: The United States of America as represented by the Secretary of the Interior, Washington, D.C.

[21] Appl. No.: 268,592

[22] Filed: May 29, 1981

Related U.S. Application Data

[63] Continuation-in-part of Ser. No. 75,385, Sep. 13, 1979, Pat. No. 4,302,051.

[51] Int. Cl.[3] ..... E21C 41/10

[52] U.S. Cl. ..... 299/7; 166/267; 208/11 LE

[58] Field of Search ..... 299/2, 7, 16, 17; 166/265, 266, 267, 272, 75 R; 208/11 LE; 210/170

[56] References Cited

U.S. PATENT DOCUMENTS

| | | | |
|---|---|---|---|
| 1,497,607 | 6/1924 | Streppel | 208/11 LE |
| 2,524,859 | 10/1950 | van Dongen | 208/11 LE |
| 2,858,890 | 11/1958 | McMahon | 166/266 |
| 2,924,566 | 2/1960 | Vaell et al. | 208/11 LE |
| 3,159,562 | 12/1964 | Bichard et al. | 208/11 LE |
| 3,644,194 | 2/1972 | Kelly et al. | 208/11 LE |
| 3,732,926 | 5/1973 | Brown et al. | 166/272 |
| 3,738,929 | 6/1973 | Terry et al. | 208/11 LE |
| 3,875,046 | 4/1975 | Rosenbloom | 208/11 LE |
| 4,212,353 | 7/1980 | Hall | 166/267 X |
| 4,224,138 | 9/1980 | Kruyer | 208/11 LE |
| 4,368,111 | 1/1983 | Siefkin et al. | 208/11 LE |

*Primary Examiner*—Stephen J. Novosad
*Assistant Examiner*—George A. Suchfield
*Attorney, Agent, or Firm*—Thomas Zack; Donald Gardiner

[57] ABSTRACT

A method for the separation of extracted viscous crude oil placed in a reservoir of a opened cell. Materials such as oil shale, oil sand, or tar sand may be involved. Hot water is introduced to the top surface of the reservoir material in the cell while steam is injected into a steam gallery running through the cell. The hot water and steam may contain a surfactant. The bouyancy of the crude oil creates an artificial water drive which causes the water and oil to "flip-flop" so that the oil rises to the top of the reservoir and separates from the remainder of the reservoir material. This separated oil may be removed from the cell and the remaining material disposed of.

1 Claim, 1 Drawing Figure

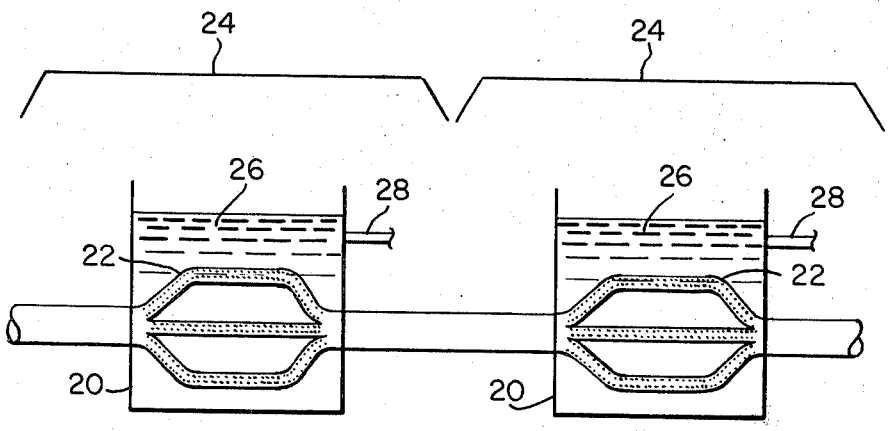
24
24
26
28
22
20
26
28
22
20

OPEN SURFACE FLOTATION METHOD FOR EXTRACTED CRUDE OIL

This application is a continuation-in-part of patent application Ser. No. 75,385 filed Sept. 13, 1979, now U.S. Pat. No. 4,302,051.

BACKGROUND OF THE INVENTION

1. Field of the Invention

The present invention relates to a method for extracting crude oil from a reservoir which is held in an opened cell.

2. Description of the Prior Art

Vast quantities of crude oil reserves are to be found in reservoirs which do not permit oil extraction by the conventional methods. These crude oil reservoirs may be in the form of viscous tar sands whose available oil adheres to or between the sand particles and may not be pumped.

Another type of reservoir is oil shale or oil saturated rock. Such oil shale is between 11 and 18% crude oil by weight and could yield approximately $3.7\times10^8$ barrels of oil per square mile for a reservoir 300 feet thick.

Yet another type of reservoir is a heavy viscous oil, or bitumen, reservoir. In such a reservoir, the bitumen is too viscous to be pumped by conventional pumping equipment.

Various attempts have been made to extract such crude oil in an economical manner. Such attempts have utilized, for example, the addition of wetting agents, surfactants, steam, water at elevated temperatures, micellar dispersions or in situ combustion. However, these prior art methods have recovered very small amounts of the in-piece fluid and in some cases required that the reservoir material be extracted prior to the extraction of the crude oil.

Known extraction methods include open pit or strip mining and, in the case where the reservoir is covered with a thick overburden, underground mining of the shale, sand, or bitumen. However, such methods are uneconomical and environmentally unsound. Pit and strip mining require the removal of the overburden which requires subsequent land reclamation while extensive underground mining is expensive and weakens the covering overburden.

Applicants are aware of one oil sand extraction method, described in U.S. Pat. No. 1,651,311 to Atkinson, which attempts to extract crude oil without the prior extraction of the entire reservoir material, that is, in situ. In Atkinson, oil sand that has been naturally flooded with water is saturated with a strong alkali, such as soda ash, caustic soda, or caustic potash at ordinary temperatures. According to Atkinson, the alkali is introduced through existing well holes and overcomes the capillary, adhesive, and viscous tendencies of the crude oil so that it separates from the sand. The crude oil then rises to the top of the already flooded wells and is removed.

However, Atkinson has several shortcomings. First, it requires large amounts of alkali. Second, it may only be used in already flooded wells. Finally, the alkali does not efficiently separate the crude oil from the sand.

SUMMARY OF THE INVENTION

This invention relates to an economical and efficient method of separating crude oil from a reservoir whose materials have been extracted from the ground. The extracted crude oil is placed in an opened cell (or cells) having a steam injection gallery. Then hot water containing a surfactant is introduced to the top surface of the crude oil and steam with a surfactant introduced into the cell's gallery. This water/steam injection permits the crude oil to separate from the remainder of the reservoir material. Following this separation, the crude oil is removed from the cell.

The method essentially consists of introducing hot water to the top surface of the extracted crude oil and injecting the cell containing the crude oil reservoir with steam, all while the crude oil remains in the cell. The steam is injected into the cell through a gallery extending into the cell. The hot water and/or steam may include a surfactant to help separate the oil from the sand or shale.

The hot water and steam heat the viscous oil and lower its viscosity while flooding the reservoir. Since the density of water is greater than that of oil, the crude oil and water at the top surface of the cell will perform a "flip-flop" and reverse positions because of gravity so that the oil rises to the top of the cell where it may be pumped out. The surfactant, if used, helps separate the sand or other extracted material from the oil so that the sand or other material does not rise with the oil but remains at the bottom of the cell. However, even without the use of a surfactant, the lowered viscosity of the crude oil should permit the separation of the extracted material from the rising crude oil.

The above method is used for materials extracted from those reservoirs which are oil wet sand. For oil wet sand, this method uses the reservoir material which is first extracted by conventional methods and placed in open cells containing steam injection gallery. The open cells may then be covered with hot water and steam introduced through the steam injection gallery. A heavy plastic sheet can cover the cells to control any released gas.

BRIEF DESCRIPTION OF THE DRAWINGS

The FIGURE is a schematic view of the present method.

DETAILED DESCRIPTION OF THE PREFERRED EMBODIMENT

The preferred embodiment will now be described with reference to the FIGURE.

As the viscosity of the crude oil within the cell decreases and the crude oil becomes more flowable, its bouyancy, the force of gravity, the adhesive, and surface forces begin to create the "flip-flop" effect which causes the oil and water within the cell to reverse positions. Most crude oils are less dense per unit volume than the same unit volume of water. For example, 1 cubic foot of water at about 20° C. weights 62.32 pounds. 1 cubic foot of 30 degree API crude oil at atmospheric pressure and 60° F. (about 15.5° C.) weights 54.60 pounds. This is a difference of 7.72 pounds which is a bouyancy force of 0.0536 pounds per square inch per foot of heat directed upwards. This bouyancy force helps to create water drive which forces the water downward and oil upward and tend to displace the oil in all portions of the reservoir.

As part of the method of the present invention, undersaturated or superheated steam is introduced into the cell at approximately the same time as the introduction of hot water The steam may be introduced immediately before, immediately after, or during the introduction of the hot water. In order to facilitate the introduction of the steam, a gallery of pipes is placed to run through the holding cell. The steam releases heat which is absorbed by the crude oil throughout the body of the reservoir material, thereby decreasing its viscosity and permitting it to be displaced by the water as a result of the water drive already discussed. As the water and oil pass during the "flip-flop," the initial heat of the water prevents the water from absorbing the heat released by the steam, which would otherwise cool the crude oil and again increase its viscosity.

The water and/or steam may contain surfactants such as sodium silicate, sodium hydroxide, or some other well-known type of surfactant. The particular type of surfactant used depends upon the type of reservoir material and crude oil. The surfactant may be introduced in an amount of 0.1% to 2% of the introduced fluid by weight. The surfactant helps to remove the adhered oil from the surface of the previously extracted reservoir material, and more completely accomplishes the separation of the crude oil from the extracted material.

Following the introduction of the steam and hot water, a period of time is required for the water drive created by the difference in bouyancy between the water and the crude oil, together with the surfactant, if used, to achieve the "flip-flop" phenomenon, the crude oil may be easily pumped off of the top of the cell and transferred to storage or to a refinery for processing. However, the water and the material remain in the cell for later disposition.

The embodiments disclosed and claimed in our referenced prior patent of which this is a continuation-in-part use "oil-wet" reservoir material in which the reservoir material is initially not flooded with water, and "water wet" reservoirs in which the reservoir material is initially flooded with water. Further, in the case of an "oil-wet" reservoirs, the "flip-flop" process can be performed subsequent to the extraction of the reservoir material as well as in situ.

In the invention herein disclosed, the reservoir material is first extracted from the ground by surface mining or other conventional methods. As shown in the drawing figure, this extracted material is initially placed in opened cells 20. These cells contain a horizontal steam injection gallery schematically shown at 22 which are disposed in the lower parts of the cells. Two material processing units 24 are illustrated with each unit's integrally structured cell being conveniently situated to permit loading with the reservoir material. Normally, the units 24 are located as close as is practical near the extraction site, such as on the top surface of the boundaries of the underground reservoirs so as to be easily accommodated by loading equipment. The top surface of the extracted reservoir material is flooded with a layer 26 of hot water, supplied through conventional piping 28, and steam injected through the steam injection gallery to create the artificial water drive as discussed above. The hot water is preferably introduced at a temperature as close to 100° C. as possible. This water should be at least 2 feet deep in the cell, and preferably from 6 to 10 deep on the upper surface of the extracted crude oil material. If gas control is required, a heavy plastic sheet can be used as a cover for the cell to capture the gas which may then be drawn off.

Obviously, many modifications and variations of the present invention are possible in light of the above teachings. It is, therefore, to be understood that within the scope of the appended claims, the invention may be practiced otherwise than as specifically described herein.

We claim:

1. A method for the separation of crude oil from an oil-wet reservoir comprising the steps of:

(a) first extracting said reservoir material from the ground;

(b) thereafter placing said extracted reservoir material within at least one open cell, each of said at least one open cells including at least one steam injection gallery, said material being in contact with the gallery;

(c) after step (b), introducing hot water at about 100° C. containing a surfactant to the top surface of the material in each of said at least one cells;

(d) at about the same time as step (c), injecting steam containing a surfactant into the reservoir material within each of said at least one cells by means of said injection gallery;

(e) permitting said crude oil to separate from the remainder of said reservoir material by flip flopping positions with the hot water after steps (c) and (d) take place; and (f) lastly, removing said separated crude oil from said at least one cell and the remainder of the reservoir material.

* * * * *